United States Patent [19]

Nishimura et al.

[11] Patent Number: 4,805,563

[45] Date of Patent: Feb. 21, 1989

[54] BLOCK CONSTRUCTION OF ENGINE

[75] Inventors: Hirofumi Nishimura; Akira Kageyama, both of Hiroshima, Japan

[73] Assignee: Mazda Motor Corporation, Hiroshima, Japan

[21] Appl. No.: 53,461

[22] Filed: May 26, 1987

[30] Foreign Application Priority Data

May 27, 1986 [JP] Japan ..... 61-121881

[51] Int. Cl.[4] ..... F02F 1/36

[52] U.S. Cl. ..... 123/41.82 A; 123/41.74

[58] Field of Search ..... 123/41.74, 41.01, 41.72, 123/41.82 R, 41.82 A

[56] References Cited

U.S. PATENT DOCUMENTS 3,203,408 8/1965 Winkelman ..... 123/41.74
3,521,613 7/1970 Celli .
3,542,001 11/1970 Line .
4,440,117 4/1984 Buchmuller .
4,590,894 5/1986 Ishida et al. ..... 123/41.74

FOREIGN PATENT DOCUMENTS 137512 10/1979 Japan .
34938 4/1981 Japan .

*Primary Examiner*—Henry A. Bennet
*Attorney, Agent, or Firm*—Burns, Doane, Swecker & Mathis

[57] ABSTRACT

The block construction of an engine and more particularly the passage construction of the cooling water in an engine having the block integrally cast, the block being provided with a head portion and a cylinder portion. The cooling operation with respect to the peripheral portion of the combustion chamber is properly performed to improve the knocking resistance and the heat load resistance of the engine, the uniform cooling effect for each cylinder in the multiple cylinder engine is retained and the cooling property with respect to the portion between the adjacent cylinders is improved.

11 Claims, 5 Drawing Sheets

BLOCK CONSTRUCTION OF ENGINE

BACKGROUND OF THE INVENTION

The present invention really relates to a block construction of an engine and, more particularly, to a passage construction of the cooling water in an engine having the block integrally cast, the block being provided with a head portion and a cylinder portion.

Generally, in the engine for motor cars, a head portion having an air inlet/exhaust ports is formed on the cylinder head, and a cylinder portion having a cylinder bore and a skirt portion for constructing a crank chamber are formed integrally on the cylinder block. However, according to such engine construction as described hereinabove, a plurality of head bolts are required to be disposed astride the cylinder block from the upper portion of the cylinder head, avoiding interferences with air inlet/exhaust ports, air inlet/exhaust valves or the like. Thus, the layout of the air inlet/exhaust system is subjected to the restriction of the bolt to considerably lower the degree of the freedom, and the both face between the cylinder head and the cylinder head is deformed under the influences of the combustion gas of high temperature and high pressure, so that the sealing property of the butt face with respect to the combustion gas becomes considerably deteriorated in the engine of high output and high rotation.

In order to cope with such a problem, a position astride the cylinder portion from the head portion is integrally formed with one block to remove the head bolt as shown in, for example, Japanese Patent Application Laid-Open Publication (Tokkaisho) No. 56-34938 and Japanese Patent Application Laid-Open Publication (Tokkaisho) No. 54-137512. The butt face between the block and the other block is adapted to be not located in the position corresponding to the combustion. Accordingly, the block construction of the engine is proposed wherein the sealing property with respect to the combustion gas is adapted to be improved with the freedom degree of the layout of the air inlet/exhaust system being enlarged.

However, as the construction of the cooling water passage (water jacket) provided on the head portion and the cylinder portion is not proper even if the engine block construction is of either one of both the above-mentioned publications, the cooling operation of the engine is not properly performed.

According to the Laid-Open publication of Japanese Patent Application (Tokkaisho) No. 56-34938, the cooling water passage is integrally formed astride the head portion and the cylinder portion, and a partition wall (lower deck) or the like is not provided between them, so that the flow speed of the cooling water passing through the passage is extremely delayed, and the cooling water of the high temperature may remain above the combustion chamber requiring the cooling effect most. In the multiple cylinder engine, the flow of the cooling water passing through the cooling water passage becomes uneven to cause dispersion in the cooling operation for each cylinder. The flow of the cooling water becomes stagnant particularly between the adjacent cylinders because of the passage shape or the layout, so that the cooling property with respect to the position is considerably deteriorated.

Also, in the Laid-Open publication of Japanese Patent Application (Tokkaisho) No. 54-137512, the inner wall (peripheral wall) of the cylinder is vertically extended to connect the inner water with the outer wall by the partition wall a little above the combustion chamber, and the passage to be formed between the inner wall and the outer wall is provided as the cooling water passage on the side of the cylinder with a through hole being formed at the direction of a nozzle or the like in its upper portion. Although the cooling property is considered to be partially improved with the through hole being directed at the nozzle, it is needless to say that the unification of the cooling operation for each cylinder and the cooling operation with respect to the portion between the adjacent cylinders are spoiled. The cooling operation with respect to the top wall of the combustion chamber is effected by the cooling water of the high temperature which flows into the cooling water passage on the side of the head portion after the heat exchange on the cooling water passage on the side of the cylinder portion, so that it is difficult to efficiently and positively lower the temperature of the combustion chamber. Also the cooling operation with respect to the combustion chamber is not properly performed, so that various harmful effects such as knocking, overheat and so on are caused in the high load of the engine producing more calorific values.

SUMMARY OF THE INVENTION

Accordingly, an object of the present invention is that the cooling operation with respect to the peripheral portion of the combustion chamber is properly performed to improve the knocking resistance and the heat load resistance of the engine, the uniform cooling effect for each cylinder in the multiple cylinder engine is retained, and the cooling property with respect to the portion between the adjacent cylinders is improved in order to cope with the above-described problem in a case where a cooling water passage (water jacket) is provided on the engine where the block is provided with the head portion and the cylinder portion.

In accomplishing the object of the present invention, there is provided the block construction of an engine which is characterized in that in the block construction of the block of the engine wherein the block composed of the head portion and the cylinder portion is integrally cast, a deck (lower deck) which partitions both the cooling water passages on the side of the head portion and on the side of the cylinder portion above the upper wall of the combustion chamber formed on the head portion and between the respective port walls of the air inlet/exhaust ports is provided, a communication passage which communicates both the cooling water passages is provided in a position corresponding to the portion between the respective bores of the deck, and the cooling water discharge opening of the water pump is connected with the cooling water passage on the side of the cylinder portion.

According to the above-described construction, a deck which partitions the cooling water passage (water jacket) on the side of the head portion from the cooling water passage on the side of the cylinder is disposed above the upper wall of the combustion chamber and between the respective port walls of the air inlet/exhaust port, the discharge opening of the water pump is adapted to be connected with the cooling water passage of the side of the cylinder portion, so that the layout of the pump is simplified, the cooling water of the low temperature discharged from the pump is fed into the cooling water passage on the side of the cylinder portion to immediately reach the peripheral portion of the upper wall of the combustion chamber, i.e., the straight lower portion of the deck. Thus, the combustion chamber is positively and properly by the cooling water in the cooling condition so as to prevent the knocking or the overheating, which is caused by much calorific amount during the high load of the engine.

Also, as a communication passage which communicates with both the cooling water passages on the side of the cylinder portion and on the side of the head portion, on the side of the head portion in the position corresponding between the bores (between the adjacent cylinders) in the deck, the smooth and positive flow of the cooling water is caused, through the introduction of the cooling water through the communication passage from the cooling water passage on the side of the cylinder portion into the cooling water passage on the side of the head portion, on the cooling water passage portion between the respective bores in the location where the flow of the cooling water is likely to be stagnant. Accordingly, the cooling effect is improved with respect to the portion between the respective bores, and the cooling operation with respect to each bore may be equalized.

DETAILED DESCRIPTION OF THE DRAWINGS

DETAILED DESCRIPTION OF THE PREFERRED EMBODIMENT

Figure 1:
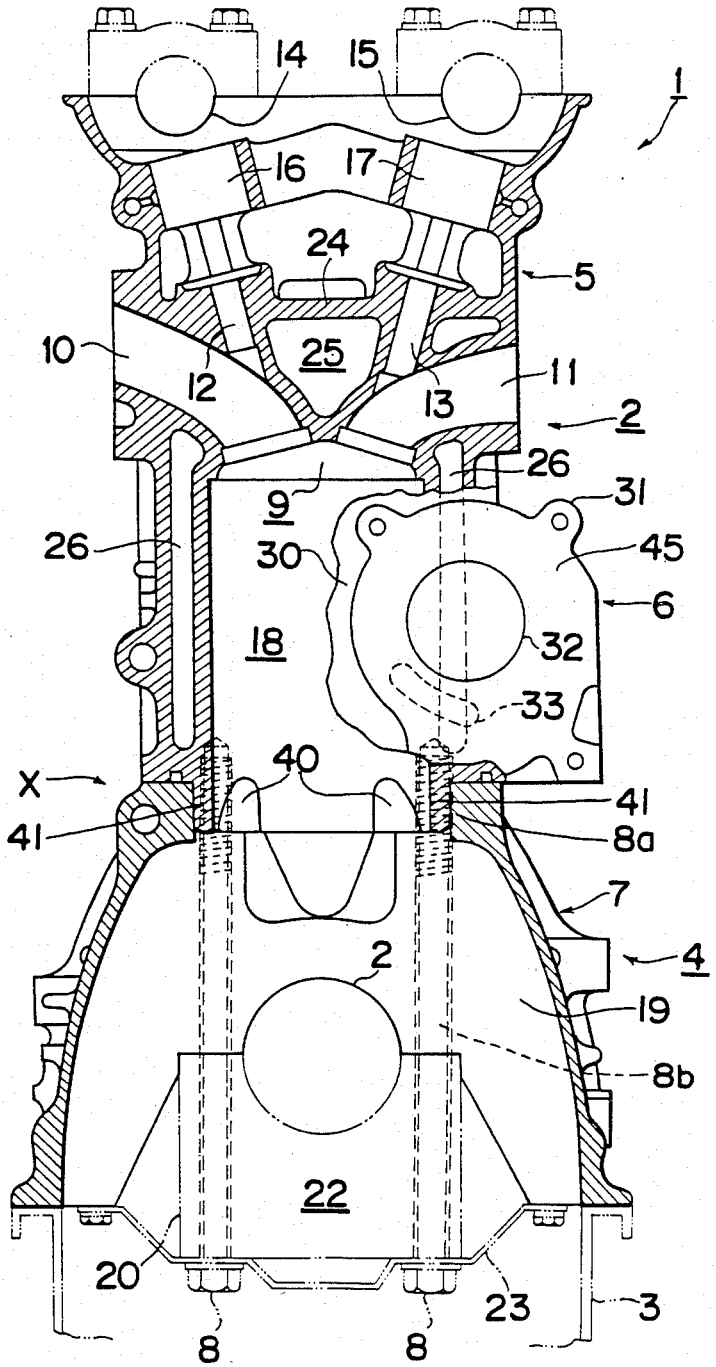
FIG. 1 is a vertical sectional view of an engine according to a preferred embodiment of the present invention.

Before the description of the present invention proceeds, it is to be noted that like parts are designated by like reference numerals throughout the accompanying drawings.

Figure 2:
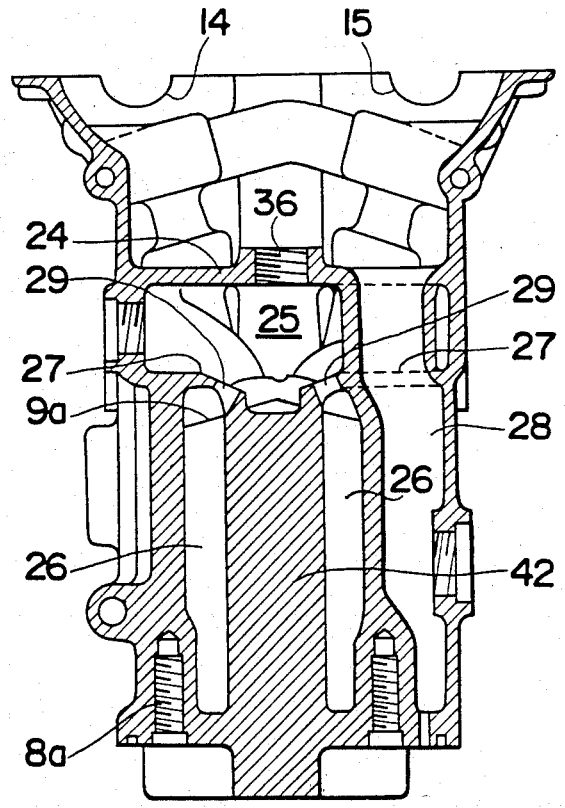
FIG. 2 is a cross-sectional view, taken along the line II—II in FIG. 3, showing blocks forming a cylinder head and a cylinder block.

Referring now to the drawings, there is shown in FIG. 1, the schematic construction of an engine according to one preferred embodiment of the present invention, wherein the main body of the engine 1 is composed of a first block 2 which has a head cover (not shown) mounted upwardly, and a second block 4 which has an oil pan 3 mounted downwardly. The first block 2 has a head portion 5 and a cylinder portion 6, and the second block 4 has a skirt portion 7. Both the first and second blocks 2 and 4 are adapted to be tightened by the bolts 8, . . . 8 with the lower end of the liner portion, i.e., the cylinder bore wall of the first block 2 being extended to form a projection portion as shown in FIG. 2 to be engaged through faucet with the side of the second block 4. A tapped hole 8*a* for tightening the bolt 8 is formed in the first block 2. A tapped hole 8*b* for bolt 8 inserting use is formed in the second block 4. An inlet port 10 and an exhaust port 11 opened respectively in the top wall of the combustion chamber 9, stem engagement holes 12, 13 of the air inlet/exhaust valves formed so as to respectively correspond to both the ports 10, 11, bearing holes, i.e., lower half portions 14, 15 of the cam shafts for respectively opening, closing the air inlet/exhaust valves, engagement holes 16, 17 of the tappets disposed between both the valves and both the cam shafts, and an ignition plug inserting hole 43 are provided in the head portion 5 of the first block 2. A cylinder bore 18 for engaging, retaining the piston is provided in the cylinder portion 6 of the first block 2. The bearing hole 21, especially its upper half portion for engaging, retaining the journal portion of the crankshaft between the bulkheads 19 positioned under between the respective adjacent bores and the bearing caps 20 formed on these walls 19 and mounted respectively under the walls 19 is provided in the second block 4 of the skirt portion 7. A crank chamber 22 is composed of the second block 4 and the oil pan 3. A reinforcing plate 23 between the skirts 23 for connecting the right, left skirt portions is adapted to be mounted in the lower end of the block 4 to prevent the skirt lower-end portion from being deformed during the operation of the engine. The second block 4, the bearing cap 20, and the reinforcing plate 23 between the skirts are adapted to be tightened together with the first block 2 by the bolts 8, 8.

The cooling water passage, i.e., water jacket of a cooling apparatus to be provided on this engine is constructed in construction as shown hereinabove.

Namely, as shown in FIG. 1 and FIG. 2, the water jacket of this engine 1 is composed of a jacket 25 on the side of the head portion formed in the head portion 5 of the first block 2 and covered at its top portion by an upper deck 24, and a jacket 26 on the side of the cylinder portion formed on the cylinder portion 6 of the first block 2 and provided on both the side portions to surround the cylinder bore 18. Both the jackets 25, 26 are partitioned by the lower decks 27, 27. A passage 28 for oil return use which returns into an oil pan 3 the lubricating oil fed into the tappet engagement holes 16, 17 and the shaft bearing holes 14, 15 is provided (see FIG. 2) on the outer side portion, i.e., the exhaust side of both the jackets 25, 26.

Figure 3:
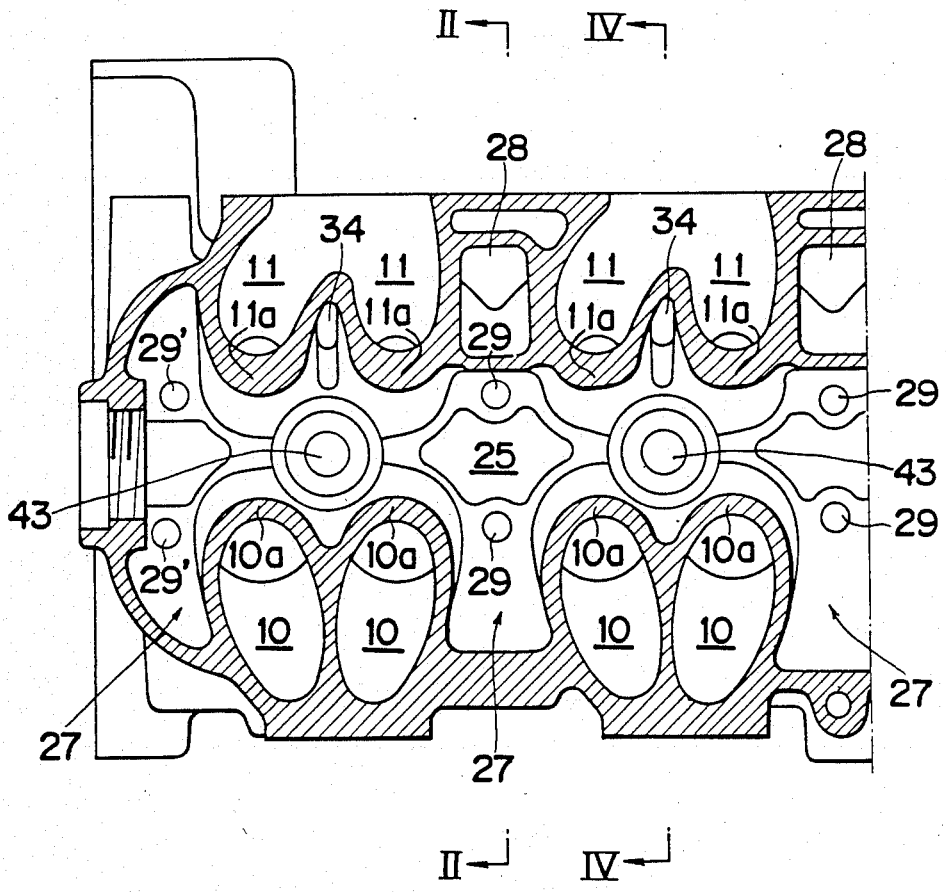
FIG. 3 is a horizontal sectional view, on an enlarged scale, of a portion of the block, cut in the vicinity of intake and exhaust ports.

However, the lower decks 27, 27 are located higher than the upper wall 9*a* of the combustion chamber 9 and are formed to couple between the respective port walls 10*a* and 11*a* of air inlet/exhaust ports 10, 11. Communication holes 29, 29 which cause the head side jacket 25 to communicate with the cylinder side jacket 26 respectively on the air inlet side and the exhaust side are provided (FIG. 3 shows the peripheral portions of two cylinders) between the respective bores in the decks 27, 27. Also, in this embodiment, similar holes 29′, 29′ are provided even in both the end portions of the engine.

Furthermore, the mounting portions 31 of the water pump is provided as shown in FIG. 1 on the front end wall 30 in the cylinder portion 6 of the first block 2. In the mounting portion 31, a pump chamber 32 which has an impeller rotated by the crank shaft as conventional is formed in its half integrally with the block 2. The pump chamber 32 is composed of a block 2 and a pump cover 45. The cooling water discharge opening 33 of the pump chamber 32 is connected with the cylinder side jacket 26.

Figure 4:
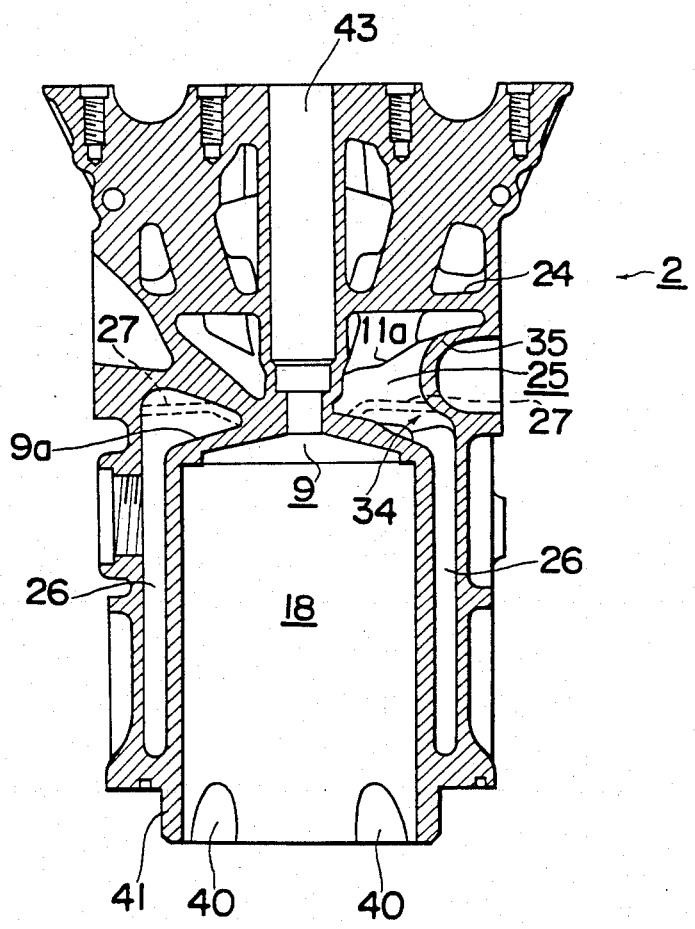
FIG. 4 is a cross-sectional view, taken along the line IV—IV in FIG. 3.
Figure 5:
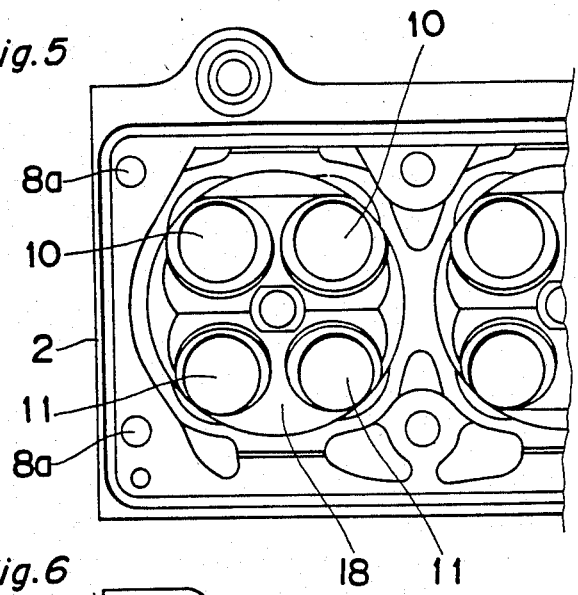
FIG. 5 is a fragmentary bottom plan view of the first block.
Figure 6:
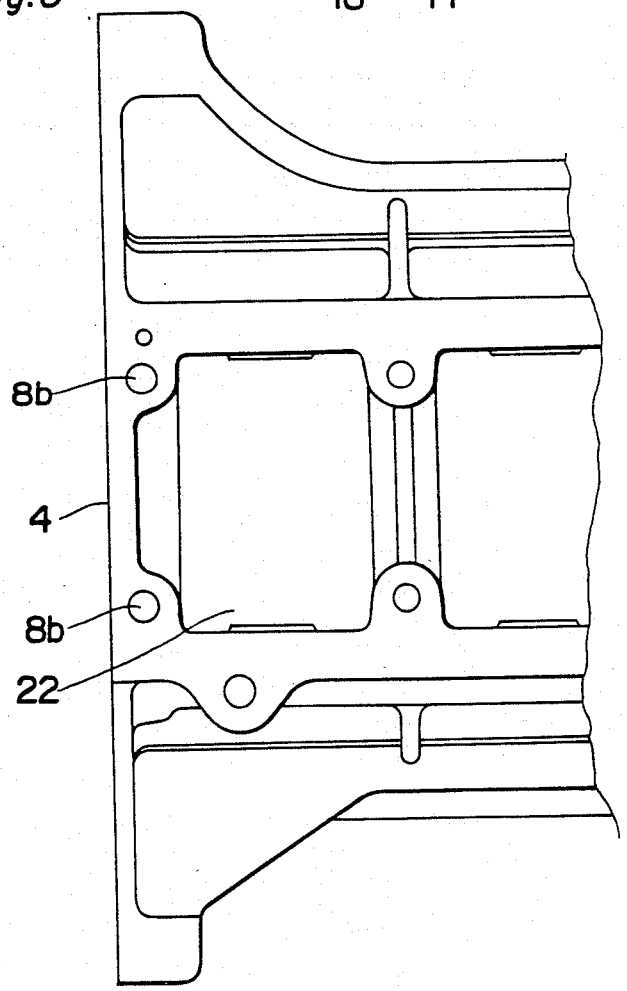
FIG. 6 is a fragmentary top plan view of the second block.

In the embodiment, the communication passages 34, 34 which cause the head side jacket 25 to communicate with the cylinder side jacket 26 are provided even between the port walls 11*a*, 11*a* of a pair of exhaust ports 11, 11 disposed for each cylinder as shown in FIG. 3 and FIG. 4, with outer wall portions 35, 35 which construct the communication passages 34, 34 are inwardly curved. The core sand-loosing holes 36, 36 are formed among the respective bores in the upper deck 24 as shown in FIG. 2. The holes 36, 36 are adapted to be used as the drill inserting holes during the machining operation of the communication holes 39, 39 in the low deck 27.

It is to be noted that after the machining operation, the screwing operation is performed so that the bolt for the blind plug may be screwed. Also, each bore is of siamese construction as conventional with adjacent bore walls being coupled. The wall 42 between the bores in FIG. 2 couples the bore walls.

According to the above-described construction, a head portion 5 having the air inlet/exhaust ports 10, 11, etc. and a cylinder portion 6 having a cylinder bore 18 are integrally formed on the first block 2, so that the freedom degree of the layout of the air inlet system may be enlarged through abolition of the conventional head bolt, and the sealing property in the periphery of the combustion chamber 9 is improved. Also, in the embodiment, the first block 2 and the second block 4 are divided with X between the cylinder portion 6 and the skirt portion 7, so that the out of roundness of the cylinder bore 18 is maintained at high precision and the machining operation from below with respect to the head portion 5 is simplified. As escape groove 40 for machining the valve sheet (not shown) from below is formed at four locations in the peripheral direction.

During the operation of this engine 1, the cooling water which is considered cold at temperature within the radiator is sucked into a pump chamber 32 formed on the water pump mounting portion 31 of the front end wall 30 by the driving operation of the water pump to be provided on the front end wall 30 of the first block 2. In addition, it is fed into the cylinder side jacket 26 through the cooling water discharge opening 33 from the pump chamber 32 for compulsory circulation within the jacket 26. In this case, a lower deck 27 which partitions the top end wall of the cylinder side jacket 26, i.e., the jacket 26, and the head side jacket 25 is provided higher than the combustion upper-wall 9*a* and between the respective port walls 10*a* and 11*a* of the air inlet/discharge ports 10, 11, so that the cooling water fed into the cylinder side jacket 26 as described hereinabove reaches the peripheral portion of the combustion chamber upper-wall 9*a*, being low at temperature, so as to efficiently cool the peripheral portion of the upper wall 9*a*. The cooling operation with respect to the combustion chamber 9 is positively and properly effected, so that the harmful influences such as knocking, overheat, etc. which are caused by such calorific value during the high load of the engine 1 are effectively prevented or controlled.

As the cooling water circulating within the cylinder side jacket 26 is guided into the head side jacket 25 through the communication holes 29, 29, 29′, 29′ provided between the bores in the lower decks 27, 27 and in both the end portions of the engine, so that the smooth flow of the smooth water is caused between the respective bores where the flow of the cooling water is likely to be particularly stagnant, and the flow amount of the cooling water to be introduced into the head side jacket 25 by the communication holes 29, 29, 29′, 29′ is properly controlled. Thus, the cooling water smoothly flows within both the jackets 25, 26 to uniformalize the cooling operation for each bore, so that the improving effect of the cooling property with respect to the portion between the respective bores.

In this embodiment, the communication passage 34 for causing both the jackets 25, 26 on the head side and on the cylinder side is formed even between a pair of exhaust ports 11, 11 for each bore, so that the cooling operation in the portion between the exhaust ports 11, 11 which is the location thermally strict in this type of engine (4 valve type engine) can be done well. As the outer wall portion 35 which is composed of the communication passage 34 is inwardly curved, the cooling water which passes through the passage 34 is pushed onto central portion side of the combustion chamber upper-wall 9*a*, particularly in the direction of the ignition plug insertion hole 43 by the operation of the outer wall portion 35 so as to improve the cooling operation to improve the cooling operation with respect to the combustion chamber 9.

Also, in the embodiment, the present invention is applied to the engine where the division face between the first block 2 and the second block 4 is provided between the cylinder portion 6 and the skirt portion 7. In addition to it, the present invention may be applied to the engine where the division face is constructed to be located in, for example, the middle portion of the cylinder portion 6 and in the position lower than the piston ring in the piston lower dead point.

As is clear from the foregoing description, according to the arrangement of the present invention, in the block construction of the engine where the block having a head portion and a cylinder portion is integrally casted, a deck (lower deck) which partitions both the cooling water passages on the side of the head portion and on the side of the cylinder portion is formed higher than the combustion chamber upper-wall, the discharge opening of the water pump is connected with the cooling water passage on the side of the cylinder, and a communication passage which causes both the cooling water passage to communicate with the portion between the respective bores in the deck is adapted to be provided, so that the combustion chamber upper wall is adapted to be cooled by the cooling water under the low temperature condition discharged into the cooling water passage on the side of the cylinder portion from the water pump and a proper amount of cooling water is guided into the cooling water passage on the side of the head portion from the side of the cylinder portion through the communication passage to cause the smooth flow of the cooling water in the portion between the respective bores where the flow is likely to be stagnant. Accordingly, the cooling operation is properly performed with respect to the combustion chamber to improve the knocking resistance and the heat load resistance of the engine, and the uniform cooling operation is performed with respect to the respective cylinders to effectively improve the cooling property with respect to the portion between the respective bores.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An engine block for a water cooled engine of the reciprocating type, comprising:

a combustion chamber including a head portion at an upper end thereof, a cylinder portion having an upper wall, and an upper wall top-face above the upper wall;

a lower deck portion defining first and second sides and first and second cooling water passages, said head portion being located to the first side of the lower deck portion and included by the first cooling water passage, the cylinder portion and the upper wall top-face being located to the second side of the lower deck portion and included by the second cooling water passage;

a communication passage communicating between the first and second cooling water passages and being formed in said lower deck portion; and a cooling water opening connected with the second cooling water passage so that cooling water may flow into the second cooling water passage and through the first cooling water passage.

2. An engine block for a water cooled multiple cylinder engine, comprising:

a first block including;

a combustion chamber including a heat portion at an upper end thereof, a cylinder portion having an upper wall, and an upper wall top-face above the upper wall;

a lower deck portion defining first and second sides and first and second cooling water passages, said head portion being located to the first side of the lower deck portion and included by the first cooling water passage, the cylinder portion and the upper wall top-face being located to the second side of the lower deck portion and included by the second cooling water passage, a communication passage communicating between the first and second cooling water passages and being formed in said lower deck portion, and a cooling water opening connected with the second cooling water passage so that cooling water may flow into the second cooling water passage and through the first cooling water passage; and a second block having a skirt portion defining a crankcase and including a bulkhead formed beneath and between adjacent cylinders, the bulkhead having a bearing portion which, together with a bearing cap, supports a crankshaft, the bearing cap including a reinforcing plate at a lower end thereof between the skirts of the skirt portion to couple the lower ends thereof, the second block, bearing cap, and reinforcing plate being adapted to be tightened together with the first block by bolts disposed between adjacent cylinders.

3. An engine block for a water cooled engine of the reciprocating type, comprising:

a first block including;

a combustion chamber including a head portion at an upper end thereof, a cylinder portion having an upper wall, and an upper wall top-face above the upper wall;

a lower deck portion defining first and second sides and first and second cooling water passages, said head portion being located to the first side of the lower deck portion and included by the first cooling water passage, the cylinder portion and the upper wall top-face being located to the second side of the lower deck portion and included by the second cooling water passage;

a communication passage communicating between the first and second cooling water passages and being formed in said lower deck portion; and a cooling water opening connected with the second cooling water passage so that cooling water may flow into the second cooling water passage and through the first cooling water passage;

a second block having a skirt portion defining a crankcase and including a bulkhead formed beneath and between adjacent cylinders, the bulkhead having a bearing portion which, together with a bearing cap, supports a crankshaft, the bearing cap including a reinforcing plate at a lower end thereof between the skirts of the skirt portion to couple the lower ends thereof, the second block, bearing cap, and reinforcing plate being adapted to be tightened together with the first block by bolts disposed between adjacent cylinders; and a pump chamber for a water pump formed on one end side wall of the first block.

4. The engine block in accordance with claim 1, wherein a plurality of combustion chambers are provided, each with its own cylinder portion, and the communication passage is provided in the lower deck portion in a position between adjacent cylinder portions.

5. An engine block for a water cooled engine of the reciprocating type, comprising:

a plurality of combustion chambers, each including a head portion at an upper end thereof, a cylinder portion having an upper wall, and an upper wall top-face above the upper wall;

a lower deck portion defining first and second sides and first and second cooling water passages, said head portions being located to the first side of the lower deck portion and included by the first cooling water passage, the cylinder portions and the upper wall top-faces being located to the second side of the lower deck portion and included by the second cooling water passage;

a communication passage communicating between the first and second cooling water passages and being formed in said lower deck portion;

a cooling water opening connected with the second cooling water passage so that cooling water may flow into the second cooling water passage and through the first cooling water passage; and a top deck portion, wherein a hole for removing core sand is formed in the top deck portion in a position centrally located between the adjacent cylinder portions, the top deck portion partitioning the first cooling water passage and an action valve chamber located above the first cooling water passage, and the communication passage is formed of a trill hole with the axial center being directed at the hole for removing the core sand.

6. The engine block in accordance with claim 4, wherein two exhaust ports are provided for each of the cylinders, the communication passage from the second cooling water passage into the first cooling water passage is provided between the exhaust ports of each cylinder.

7. An engine block for a water cooled engine of the reciprocating type, comprising:

a plurality of combustion chambers, each including a head portion at an upper end thereof, a cylinder portion having an upper wall, and an upper wall top-face above the upper wall;

a lower deck portion defining first and second sides and first and second cooling water passages, said head portions being located to the first side of the lower deck portion and included by the first cooling water passage, the cylinder portions and the upper wall top-face being located to the second side of the lower deck portion and included by the second cooling water passage;

a communication passage communicating between the first and second cooling water passages and being formed in said lower deck portion; and a cooling water opening connected with the second cooling water passage so that cooling water may flow into the second cooling water passage and through the first cooling water passage wherein two exhaust ports are provided for each of the cylinders, the communication passage from the second cooling water passage into the first cooling water passage being provided between the exhaust ports of each cylinder and being directed and opened at an ignition plug insertion hole wall in the upper wall central portion of the combustion chamber.

8. An engine block for a water cooled engine of the reciprocating type, comprising:

a plurality of combustion chambers, each including a head portion at an upper end thereof, a cylinder portion having an upper wall, and an upper wall top-face above the upper wall;

a lower deck portion defining first and second sides and first and second cooling water passages, said head portions being located to the first side of the lower deck portion and included by the first cooling water passage, the cylinder portion and the upper wall top-face being located to the second side of the lower deck portion and included by the second cooling water passage;

a communication passage communicating between the first and second cooling water passages and being formed in said lower deck portion; and a cooling water opening connected with the second cooling water passage so that cooling water may flow into the second cooling water passage and through the first cooling water passage; wherein a pump chamber for accommodating an impeller of a water pump at one end of the cylinder portion is formed, and a cooling water opening is provided between the pump chamber and the second cooling water passage.

9. The engine block in accordance with claim 1, wherein the block is composed of a first block having a head portion and a cylinder portion, a second block forming a skirt portion, and the lower end of the cylinder portion is downwardly extended to be faucet-engaged with the second block and is tightened by a bolt from below.

10. An engine block for a water cooled engine of the reciprocating type, comprising:

a plurality of combustion chambers, each including a head portion at an upper end thereof, a cylinder portion having an upper wall, and an upper wall top-face above the upper wall;

a lower deck portion defining first and second sides and first and second cooling water passages, said head portion being located to the first side of the lower deck portion and included by the first cooling water passage, the cylinder portions and the upper wall top-face being located to the second side of the lower deck portion and included by the second cooling water passage;

a communication passage communicating between the first and second cooling water passages and being formed in said lower deck portion; and a cooling water opening connected with the second cooling water passage so that cooling water may flow into the second cooling water passage and through the first cooling water passage wherein the block is composed of a first block having the head portion and the cylinder portion, and a second block forming a skirt portion, the lower end of the cylinder portion being downwardly extended to be faucet-engaged with the second block and being tightened by a bolt from below, an escape groove for a valve seat machining use of the air inlet/exhaust port being formed in an inner peripheral face of a liner portion of the first block lower end.

11. An engine block for a water cooled engine of the reciprocating type, comprising:

a plurality of combustion chambers, each including a head portion at an upper end thereof, a cylinder portion having an upper wall, and an upper wall top-face above the upper wall;

a lower deck portion defining first and second sides and first and second cooling water passages, said head portion being located to the first side of the lower deck portion and included by the first cooling water passage, the cylinder portion and the upper wall top-face being located to the second side of the lower deck portion and included by the second cooling water passage;

a communication passage communicating between the first and second cooling water passages and being formed in said lower deck portion; and a cooling water opening connected with the second cooling water passage so that cooling water may flow into the second cooling water passage and through the first cooling water passage wherein the block is composed of a first block having the head portion and the cylinder portion, and a second block forming a skirt portion, the lower end of the cylinder portion being downwardly extended to be faucet-engaged with the second block and being tightened by a bolt from below, the second block and the main bearing cap being tightened together by a bolt on the first block lower end.

* * * * *